US008308529B2

(12) United States Patent
D'Ambra et al.

(10) Patent No.: US 8,308,529 B2
(45) Date of Patent: Nov. 13, 2012

(54) HIGH THROUGHPUT CHEMICAL MECHANICAL POLISHING SYSTEM

(75) Inventors: Allen L. D'Ambra, Burlingame, CA (US); Alpay Yilmaz, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 591 days.

(21) Appl. No.: 12/427,411

(22) Filed: Apr. 21, 2009

(65) Prior Publication Data

US 2009/0270015 A1 Oct. 29, 2009

Related U.S. Application Data

(60) Provisional application No. 61/047,943, filed on Apr. 25, 2008.

(51) Int. Cl.
*B24B 5/00* (2006.01)
*B24B 41/02* (2006.01)

(52) U.S. Cl. ..... 451/65; 451/287; 451/332

(58) Field of Classification Search ..... 451/28, 451/41, 54, 56, 57, 60, 114, 159, 259, 285, 451/287, 332, 65
See application file for complete search history.

(56) References Cited

U.S. PATENT DOCUMENTS

| | | | | |
|---|---|---|---|---|
| 5,335,453 | A | 8/1994 | Baldy et al. | |
| 5,534,106 | A * | 7/1996 | Cote et al. | 451/287 |
| 5,738,574 | A | 4/1998 | Tolles et al. | |
| 6,036,582 | A | 3/2000 | Aizawa et al. | |
| 6,110,024 | A | 8/2000 | Togawa | |
| 6,227,946 | B1 | 5/2001 | Gonzalez-Martin et al. | |
| 6,309,279 | B1 * | 10/2001 | Bowman et al. | 451/41 |
| 6,406,359 | B1 | 6/2002 | Birang et al. | |
| 6,488,565 | B1 | 12/2002 | White et al. | |
| 6,500,051 | B1 * | 12/2002 | Nishi et al. | 451/41 |
| 6,780,083 | B2 * | 8/2004 | Ising et al. | 451/287 |
| 7,374,471 | B2 * | 5/2008 | Jeong | 451/285 |
| 2005/0242063 | A1 | 11/2005 | Ising et al. | |
| 2006/0035563 | A1 | 2/2006 | Kalenian et al. | |
| 2009/0258574 | A1 * | 10/2009 | Yilmaz et al. | 451/28 |

FOREIGN PATENT DOCUMENTS

| | | |
|---|---|---|
| JP | 10-173024 | 6/1998 |
| JP | 2006-179955 | 7/2006 |

OTHER PUBLICATIONS

International Search Report and Written Opinion dated Dec. 14, 2009 for International Application No. PCT/US2009/041133.
Official Letter dated Dec. 16, 2011, from Chinese Patent Office for corresponding China Patent Application No. 200980112926.7.

* cited by examiner

*Primary Examiner* — Hadi Shakeri
(74) *Attorney, Agent, or Firm* — Patterson & Sheridan, LLP

(57) ABSTRACT

Embodiments of a system and method for polishing substrates are provided. In one embodiment, a polishing system is provided that includes a polishing module, a cleaner and a robot. The robot has a range of motion sufficient to transfer substrates between the polishing module and cleaner. The polishing module includes at least two polishing stations, at least one load cup and at least four polishing heads. The polishing heads are configured to move independently between the at least two polishing stations and the at least one load cup.

12 Claims, 17 Drawing Sheets

HIGH THROUGHPUT CHEMICAL MECHANICAL POLISHING SYSTEM

CROSS-REFERENCE TO RELATED APPLICATION

This application claims benefit of U.S. Provisional Application Ser. No. 61/047,943, filed Apr. 25, 2008, which is incorporated by reference in its entirety.

BACKGROUND

1. Field of the Invention

Embodiments of the present invention generally relate to a chemical mechanical polishing system suitable for use in semiconductor manufacturing.

2. Description of the Related Art

In semiconductor substrate manufacturing, the use of chemical mechanical polishing, or CMP, has gained favor due to the widespread use of damascene interconnects structures during integrated circuit (IC) manufacturing. Although many commercially available CMP systems have demonstrated robust polishing performance, the move to smaller line widths requiring more precise fabrication techniques, along with a continual need for increased throughput and lower cost of consumables, drives an ongoing effort for polishing system improvements. Moreover, most conventional polishing systems have relatively limited flexibility for changes to processing routines, thereby limiting the diversity of processes that may be run through a single tool. Thus, certain new processing routines may require new or dedicated tools, or costly downtime for substantial tool configurational changes.

Therefore, there is a need for an improved chemical mechanical polishing system.

SUMMARY OF THE INVENTION

Embodiments of the invention include a system and method for polishing substrates are provided. In one embodiment, a polishing system is provided that includes a polishing module, a cleaner and a robot. The robot has a range of motion sufficient to transfer substrates between the polishing module and cleaner. The polishing module includes at least two polishing stations, at least one load cup and at least four polishing heads. Each of the polishing heads are configured to move independently between the at least two polishing stations and the at least one load cup.

In another embodiment, a method for polishing a substrate is provided that includes simultaneously polishing two substrates retained in independently movable polishing heads on a first polishing surface of a polishing module, simultaneously polishing the two substrates retained in the independently movable polishing heads on a second polishing surface of the polishing module, simultaneously transferring the two polished substrates from the independently movable polishing heads to a pair of load cups, and simultaneously cleaning the two polished substrates in a pair cleaning modules.

In yet another embodiment, a polishing system includes a polishing module comprising at least two polishing stations, at least two load cups, at least four polishing heads coupled to a overhead track disposed in the polishing module, wherein the polishing heads moves independently in a rail between the at least two polishing stations and the at least one load cup defined in the overhead track.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings.

Figure 1:
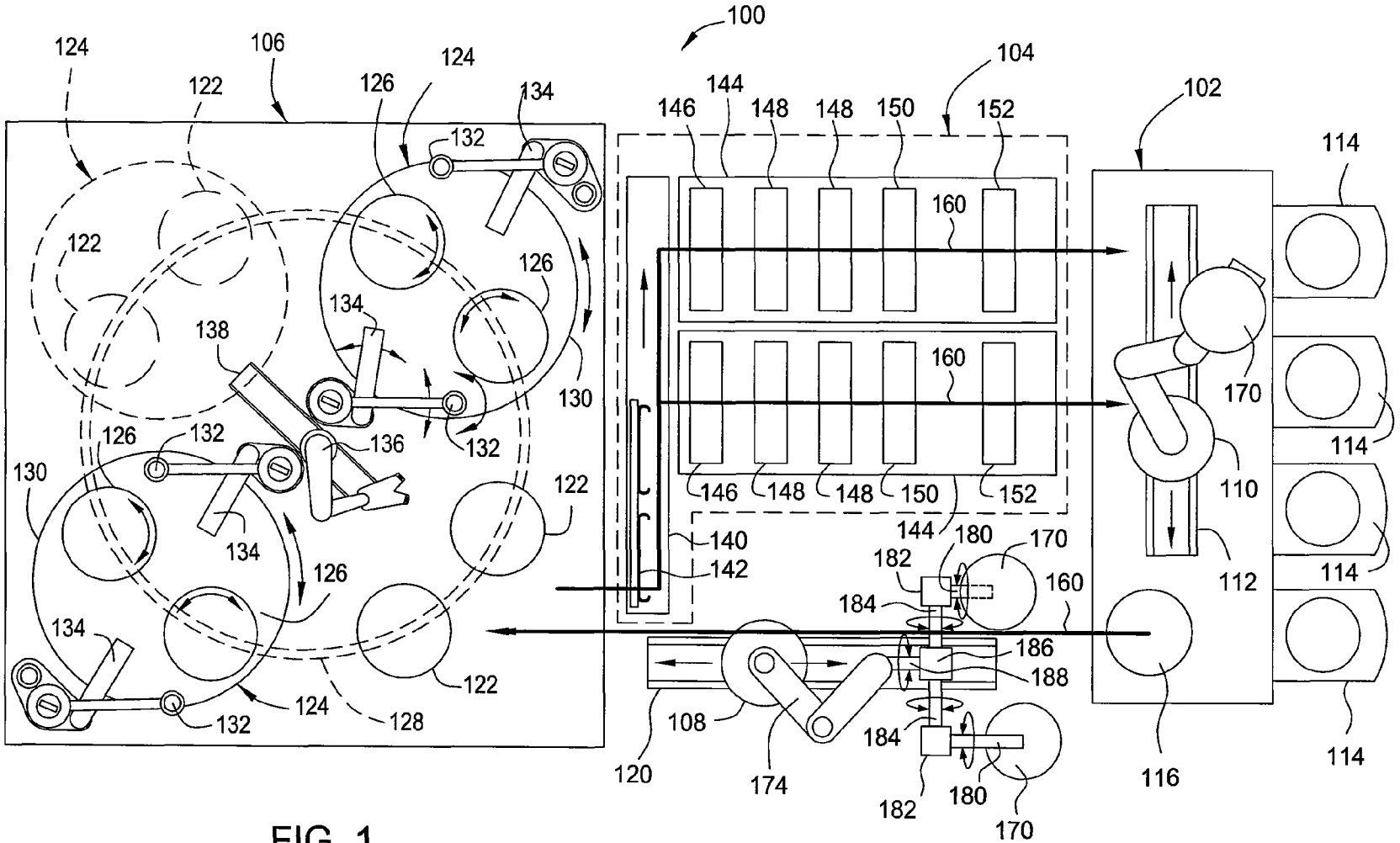
FIG. 1 is a plan view of one embodiment of a chemical mechanical polishing system.

It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

FIG. 1 is a plan view of one embodiment of a polishing system 100. The polishing system 100 generally includes a factory interface 102, a cleaner 104 and a polishing module 106. A wet robot 108 is provided to transfer substrates 170 between the factory interface 102 and the polishing module 106. The wet robot 108 may also be configured to transfer substrates between the polishing module 106 and the cleaner 104. In one mode of operation, the flow of substrates, such as semiconductor wafers or other work piece, through the polishing system 100 is indicated by arrows 160. The flow of the substrates may be varied through the polishing module 106, some embodiments of which are discussed further below with reference to FIGS. 8A-13C.

The factory interface 102 generally includes a dry robot 110 which is configured to transfer substrates 170 between one or more cassettes 114 and one or more transfer platforms 116. In the embodiment depicted in FIG. 1, four substrate storage cassettes 114 are shown. The dry robot 110 generally has sufficient range of motion to facilitate transfer between the four cassettes 114 and the one or more transfer platforms 116. Optionally, the dry robot 110 may be mounted on a rail or track 112 to position the dry robot 110 laterally within the factory interface 102, thereby increasing the range of motion of the dry robot 110 without requiring large or complex robot linkages. The dry robot 110 additionally is configured to receive substrates from the cleaner 104 and return the clean polish substrates to the substrate storage cassettes 114. Although one substrate transfer platform 116 is shown in the embodiment depicted in FIG. 1, two or more substrate transfer platforms may be provided so that at least two substrates may be queued for transfer to the polishing module 106 by the wet robot 108 at the same time.

The wet robot 108 generally has sufficient range of motion to transfer substrates between the transfer platform 116 of the factory interface 102 and a load cup 122 disposed on the polishing module 106. In one embodiment, the wet robot 108 is mounted on a track 120 facilitates linear translation of the wet robot 108. The track 120 may be mounted to the floor of the facility to isolate vibrations produced during substrate transfer. Alternatively, the track 120 may be coupled to at least one of the factory interface 102, the polishing module 106 or the cleaner 104.

Figure 2:
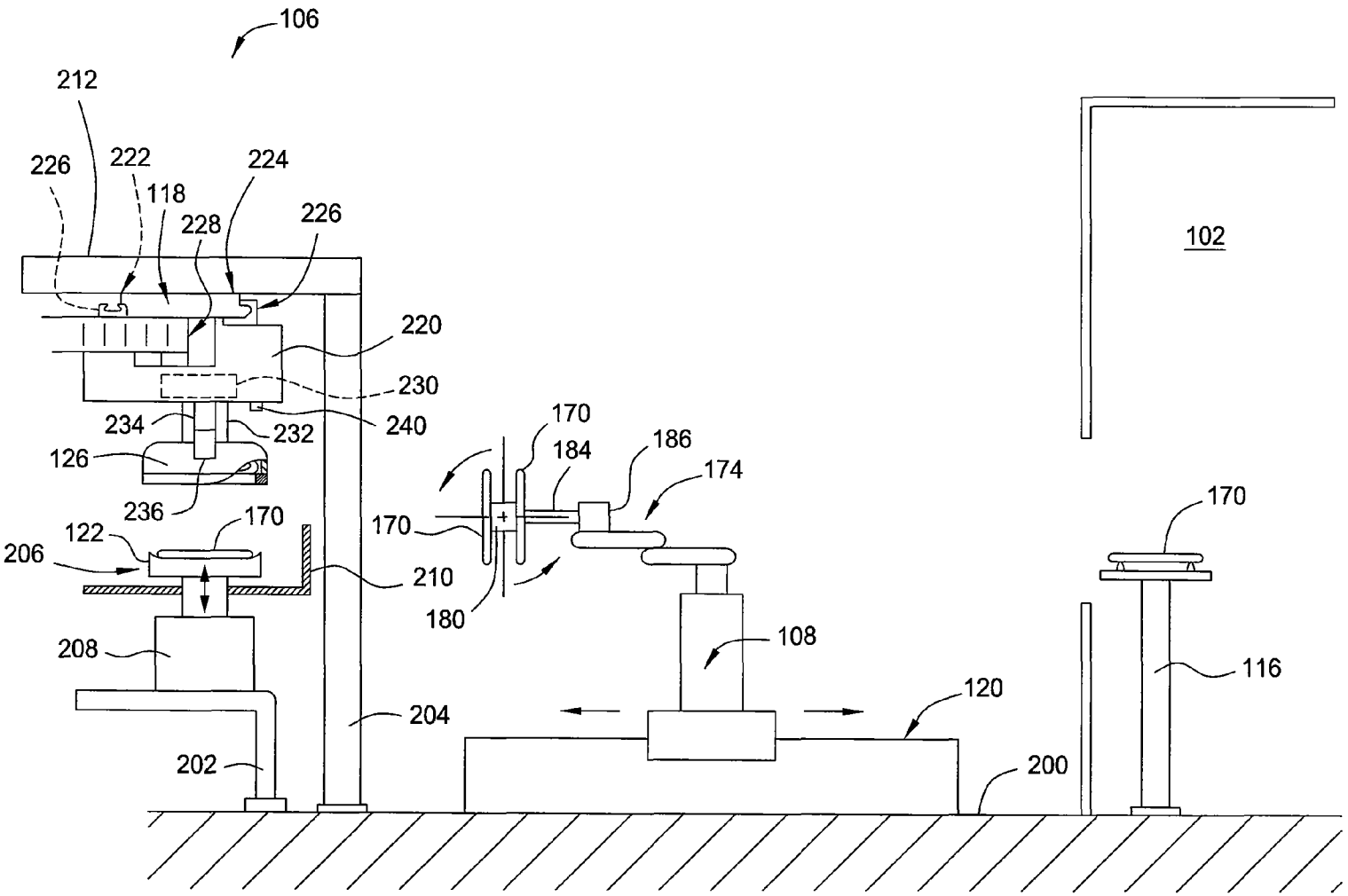
FIG. 2 is a partial side view of the chemical mechanical polishing system of FIG. 1 illustrating one embodiment of a wet robot.

Referring additionally to a partial side view of the polishing system 100 in FIG. 2, the wet robot 108 is configured to have the range of motion sufficient to retrieve the substrate 170 in a feature-side-up (face-up) orientation from the transfer platform 116 and place the substrate in either one of the load cups 122 in a feature-side-down (face-down) orientation. It is contemplated that any one of a number of robots may be adapted to perform this motion.

In one embodiment, the wet robot 108 includes a linkage 174 coupled to a wrist assembly 176. The linkage 174 is configured to extend and retract the wrist assembly 176 relative to a body of the wet robot 108. The wrist assembly 176 generally includes a first member 188 which couples a first connector 186 to the linkage 174. A motor (not shown) is provided to rotate first connector 186 about an axis defined through the first member 188. Second members 184 extend from each side of the first connector 186. Each of the second members 184 are coupled to a second connector 182. A motor (not shown) is provided to rotate the second connector 182 about an axis defined through the second member 184. In one embodiment, each of the second connectors 182 may be independently rotated. Generally, the orientation of the first and second members 188, 184 are perpendicular. An end effector 180 extends from the second connector 182 in orientation perpendicular to the second member 184. A motor (not shown) may be provided to rotate the end effector 180 on its long axis.

The end effector 180 generally includes at least one gripper, such as a mechanical clamp or suction device which secures the substrate 170 thereto. In one embodiment, a gripper is provided on both sides of the end effector 180 to selectively secure substrates to either side of the end effector 180. In this manner, a single end effector 180 may be utilized to hold two substrates simultaneously, and/or hold polished and unpolished substrates dedicated sides of the end effector 180. In one mode of operation illustrating the efficiency of the wet robot 108, the end effector 180 may hold an unprocessed substrate while retrieving a process substrate from a load cup 122, then be rotate 180 degrees to deposit the unprocessed substrate in the load cup without leaving the vicinity of the polishing module.

The range of motion of the end effector 180 allow substrates to be retrieved from the factory interface 102 in a face-up horizontal orientation, be flipped to a face-down horizontal orientation to facilitate transfer with the load cups 122 and turned on-edge in a vertical orientation during transfer to the cleaner 104.

Still referring to both FIGS. 1-2, the polishing module 106 includes a plurality of polishing stations 124 on which substrates are polished while retained in one or more polishing heads 126. The polishing stations 124 may be sized to interface with one or more polishing heads 126 simultaneously so that polishing of one or more substrates may occur a single polishing station 124 at the same time. The polishing heads 126 are coupled to a carriage 220 that is mounted to an overhead track 128. The overhead track 128 allows the carriage 220 to be selectively positioned around the polishing module 106 which facilitates positioning the polishing heads 126 selectively over the polishing stations 124 and load cup 122. In the embodiment depicted in FIGS. 1-2, the overhead track 128 has a circular configuration (shown in phantom in FIG. 1) which allows the carriages 220 retaining the polishing heads 126 to be selectively rotated over and/or clear of the load cups 122 and the polishing stations 124. It is contemplated that the overhead track 128 may have other configurations including elliptical, oval, linear or other suitable orientation.

Although the embodiment of FIGS. 1-2 depict a polishing module 106 having two polishing stations 124, it is contemplated that the polishing module 106 may include a single polishing station 124, three polishing stations 124, or other number of polishing stations 124 which may fit on the polishing module 106. It is also contemplated that the polishing module 106 may include a single load cup 122 to service all of the polishing stations 124, or other number of load cups 122 desired.

In one embodiment, the overhead track 128 is coupled to an outer frame 204 while the polishing stations 124 are coupled to an inner frame 202. The inner and outer frames 202, 204 are coupled to a floor 200 of the facility without being connected to each other. The decoupled inner and outer frames 202, 204 allows vibrations associated with the movement of the carriages 220 to be substantially isolated from the polishing surface 130, thereby minimizing potential impact to polishing results. Moreover, utilization of the inner frame 202 without a machine base provides significant cost savings over conventional designs.

A basin 210 is disposed on the inner frame 202 to catch and channel liquids within the polishing module 106. Since the basin 210 is not a structural member, the basin 210 may be formed in a manner that incorporates intricate contours for liquid channeling and component shielding. In one embodiment, the basin 210 is a vacuum-formed plastic member.

In the embodiment depicted in FIG. 2, a partial view of the interface between the overhead track 128 and carriage 220 is shown. The carriage 220 is coupled by a guide 226 to an inner rail 222 and an outer rail 224 of the overhead track 128. The inner and outer rails 222, 224 are coupled to the outer frame 204. The inner and outer rails 222, 224 and guide 226 comprise a precision bearing assembly, such as available from THK Co., Ltd. CORPORATION, located in Tokyo, Japan.

Each carriage 220 is controllably positioned along the inner and outer rails 222, 224 of the overhead track 128 by an actuator 228. The actuator 228 may be in the form of a gear motor, servo motor, linear motor, sawyer motor or other motion control device suitable for accurately positioning the carriage 220 along the overhead track 128. The carriage 220 is utilized to position the polishing head 126 over the load cups 122 or polishing surface 130, to sweep the polishing head 126 across polishing surface 130 during processing, or to position the polishing head 126 clear of the load cups 122 and polishing surface 130 for maintenance of the polishing head 126, the load cups 122 or polishing surface 130. In one embodiment, each carriage 220 includes a linear motor that interfaces with a magnetic track coupled to the outer frame 204 having magnets arranged in alternating polarity so that each carriage 220 may be moved independently of the other carriages 220 coupled to the overhead track 128.

In one embodiment, each carriage 220 supports a single polishing head 126. Examples of suitable polishing heads that may be adapted to benefit from the invention include those sold under the TITAN trademark by Applied Materials, Inc. It is contemplated that other polishing heads may also be utilized.

The polishing head 126 is coupled to the carriage 220 by a shaft 232. A motor 234 is coupled to the carriage 220 and is arranged to controllably rotate the shaft 232, thereby rotating the polishing head 126 and substrate 170 disposed therein during processing.

At least one of the polishing head 126 or carriage 220 includes and actuator 236 for controlling the elevation of the polishing head 126 relative to the polishing surface 130. In one embodiment the actuator 236 allow the polishing head 126 to be pressed against the polishing surface 130 at about 6 psi or less, such as less than about 1.5 psi.

Optionally, one or more of the carriages 220 may support an accessory device 240. The accessory device 240 may be a pad metrology unit, a polishing surface conditioning device, a sensor for detecting the condition of the polishing surface 130 or other object, substrate defect mapping device, substrate metrology unit, a vacuum for pad cleaning, a slurry or polishing fluid delivery nozzle, a camera or video device, a laser, one or more cleaning fluid jets, a platen assembly lifting fixture or other device. The accessory device 240 may be coupled to the carriage 220 in addition to, or in place of, the polishing head 126.

For example, one of the polishing heads 126 may be decoupled from the carriage 220 and replaced with accessory device 240. The accessory device 240 may be utilized during processing and/or system cleaning, among other times. Additionally, since each carriage 220 moves independently from the other carriages, the accessory device 240 may replace one of the polishing heads 126 while the other the polishing heads 126 are utilized for substrate processing with little or no impact to substrate throughput.

Referring now primarily to FIG. 1, two polishing stations 124 are shown, located in opposite corners of the polishing module 106. At least one load cup 122 (two load cups 122 are shown) is in the corner of the polishing module 106 between the polishing stations 124 closest the wet robot 108. Optionally, a third polishing station 124 (shown in phantom) may be positioned in the corner of the polishing module 106 opposite the load cups 122. Alternatively, a second pair of load cups 122 (also shown in phantom) may be located in the corner of the polishing module 106 opposite the load cups 122 that are positioned proximate the wet robot. It is contemplated that additional polishing stations 124 may be integrated in the polishing module 106 in systems having a larger footprint.

In such an embodiment having two pairs of load cups 122, an optional staging robot 136 may be employed to transfer the substrate between load cups 122. The staging robot 136 may be slidebly mounted to a track 138 to increase the range of motion of the staging robot 136. The track 138 may be linear, as shown, circular or other configuration. The staging robot 136 may also be configured to flip the substrate for interfacing with a substrate metrology unit (accessory device 240) when the substrate metrology unit is coupled to one of the carriages 220 or positioned elsewhere within the range of motion of the staging robot 136. The flipped substrate may be disposed in one of the load cups or held by the staging robot 136 while interfacing with the substrate metrology unit.

The load cups 122 generally facilitate transfer between the wet robot 108 and the polishing head 126. Embodiments of suitable load cups are disclosed in, but not limited to, as described in U.S. patent application Ser. No. 09/414,907, filed Oct. 8, 1999; U.S. patent application Ser. No. 10/988,647, filed Nov. 15, 2004; U.S. patent application Ser. No. 11/757,193, filed Jun. 1, 2007, all of which are incorporated in by reference in their entireties.

Each polishing station 124 generally includes a polishing surface 130, a conditioning module 132 and a polishing fluid delivery module 134. The polishing surface 130 is supported on a platen assembly (not shown in FIG. 1) which rotates the polishing surface 130 during processing. In one embodiment, the polishing surface 130 is suitable for at least one of a chemical mechanical polishing and/or an electrochemical mechanical polishing process.

FIGS. 3A-D depict various embodiments of platen assemblies that may be utilized for supporting the polishing surface 130. Although not depicted herein, the platen assemblies may include endpoint detection equipment, such as an interferometric device, one embodiment of which is described in U.S. patent application Ser. No. 09/244,456, filed Feb. 4, 1999, which is incorporated by reference in its entirety.

Figure 3A:
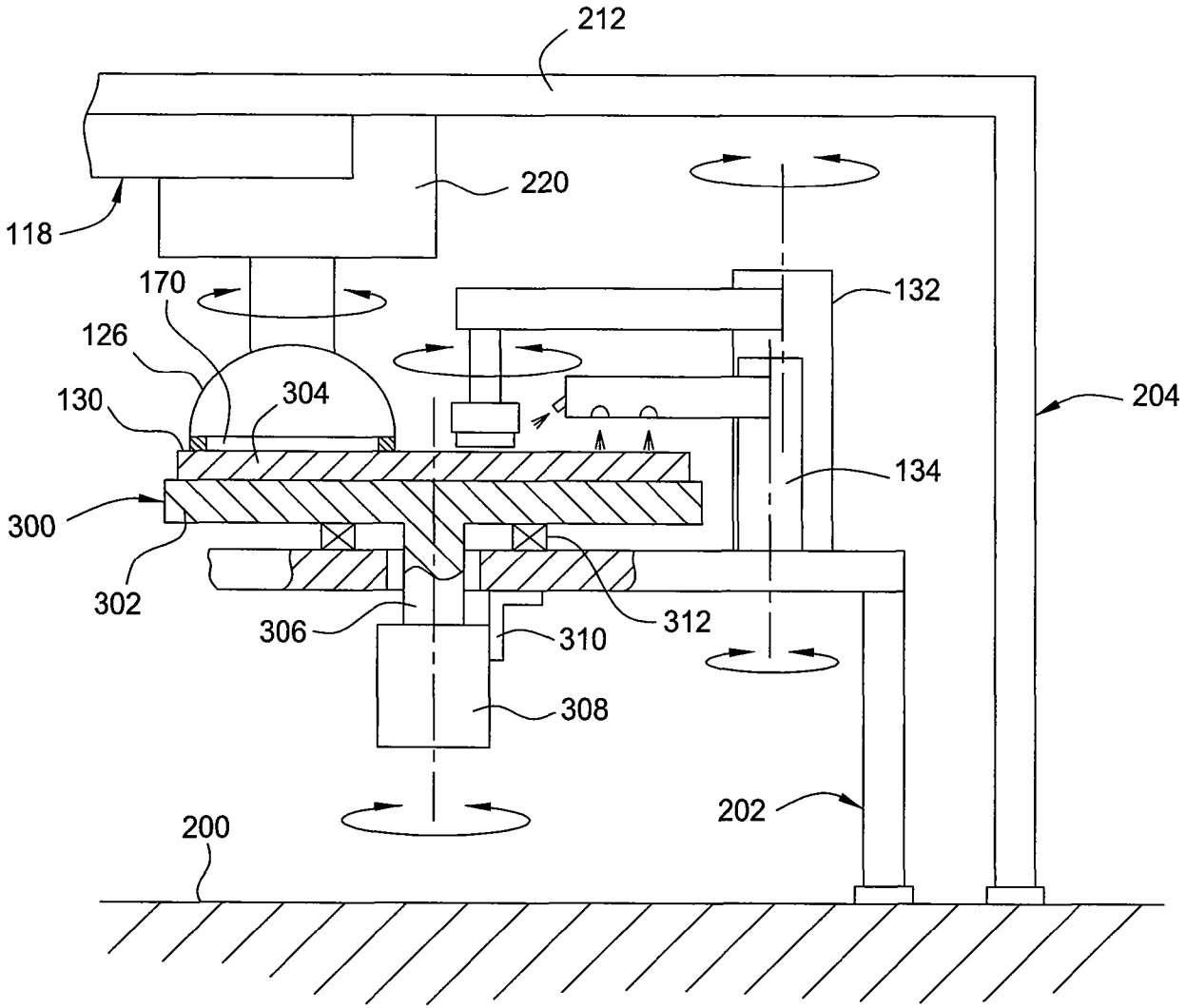
FIGS. 3A-D depict various embodiments of a polishing station.

In the embodiment depicted in FIG. 3A, a platen assembly 300 supports a dielectric polishing pad 304. The upper surface of the pad 304 forms the polishing surface 130. The platen assembly 300 is supported on the inner frame 202 by one or more bearings 312. The platen 302 is coupled by a shaft 306 to a motor 308 that is utilized to rotate the platen assembly 300. The motor 308 may be coupled by a bracket 310 to the inner frame 202. In one embodiment, the motor 308 is a direct drive motor. It is contemplated that other motors may be utilized to rotate the shaft 306. In the embodiment depicted in FIG. 3A, the motor 308 is utilized to rotate the platen assembly 300 such that the pad 304 retained thereon is rotated during processing while the substrate 170 is retained against the polishing surface 130 by the polishing head 126. It is contemplated, as shown in FIG. 1, that the platen assembly 300 may be large enough to support a polishing pad 304 which will accommodate polishing of at least two substrates retained by different polishing heads 126. In one embodiment, the dielectric polishing pad 304 is greater than 30 inches in diameter, for example, between about 30 and about 52 inches, such as 42 inches. Even though the dielectric polishing pad 304 may be utilized to polish two substrates simultaneously, the pad unit area per number of substrate simultaneously polished thereon is much greater than conventional single substrate pads, thereby allowing the pad service life to be significantly extended, for example, approaching about 2000 substrates per pad.

During processing or when otherwise desired, the conditioning module 132 may be activated to contact and condition the polishing surface 130. Additionally, polishing fluid is delivered through the polishing fluid delivery module 134 to the polishing surface 130 during processing. The distribution of fluid provided by the polishing fluid delivery module 134 may be selected to control the distribution of polishing fluid across the lateral surface of the polishing surface 130. It should be noted that only one polishing head 126, conditioning module 132 and polishing fluid delivery module 134 are depicted in FIG. 3A for the sake of clarity.

Figure 3B:
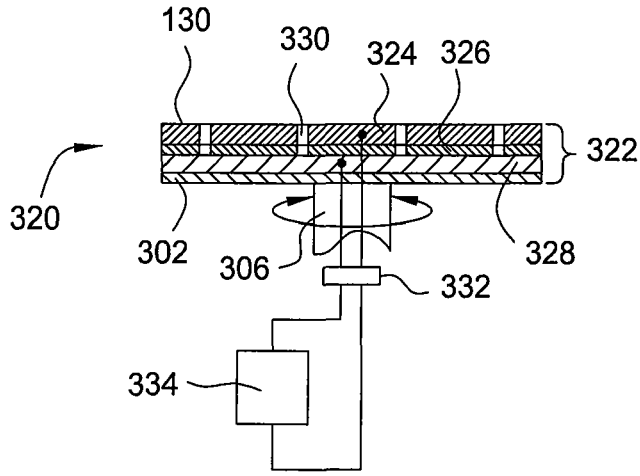

FIG. 3B depicts another embodiment of a platen assembly 320. In one embodiment, the conductive pad assembly 322 includes a subpad 326 sandwiched between a conductive layer 324 and an electrode 328. The electrode 328 is disposed on or proximate the platen 302. The upper surface of the conductive layer 324 defines the polishing surface 130. A plurality of holes or apertures 330 are formed through the conductive layer 324 and subpad 326 so that the electrode 328 is exposed to the polishing surface 130. A power source 334 is coupled through a slip ring 332 to the electrode 328 and the conductive layer 324. The conductive layer 324 couples the power source 334 to the substrate 170 disposed on the polishing surface 130. During processing, a conductive polishing fluid is disposed on the polishing surface 130 by the fluid delivery arm filling the apertures 330, thereby providing a conductive path between the electrode 328 and the substrate 170 disposed on the conductive layer 324. When a potential difference is provided between the conductive layer 324 and the electrode 328, an electromechanical polishing process is driven to remove conductive material such as copper, tungsten and the like, may be performed on the substrate. One example, not by way of limitation of a conductive pad assembly that may be adapted to benefit from the invention is described in U.S. patent Ser. No. 10/455,895, filed Jun. 6, 2003, which is incorporated by reference in its entirety.

Figure 3C:
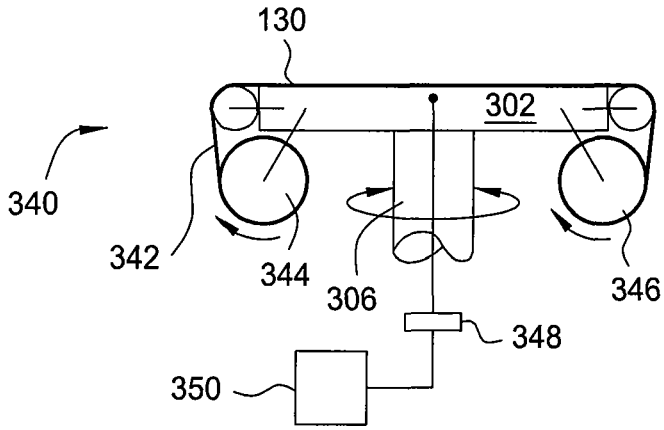

FIG. 3C depicts another embodiment of a platen assembly 340 which supports a web of polishing material 342 which defines the polishing surface 130. The web of polishing material 342 is disposed on the platen 302 between a supply roll 344 and a take-up roll 346. The polishing material 342 may be incrementally indexed across the surface of the platen 302 or continuously translated across the platen 302 during processing. Alternatively, the web of polishing material 342 may be a continuous belt. In another embodiment, the web of polishing material 342 may be indexed between processing substrates. The web of polishing material 342 may be retained to the platen 302 by application of a vacuum provided from a vacuum source 350 through a rotary coupler 348. Embodiments of a platen assembly which may be adapted to benefit from the invention are described in the previously incorporated U.S. patent application Ser. No. 09/244,456, filed Feb. 4, 1999.

Figure 3D:
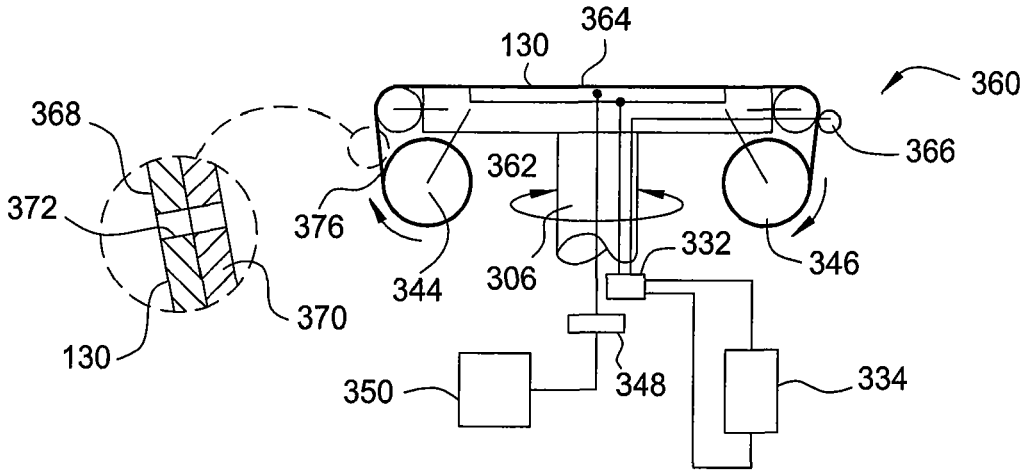

FIG. 3D depicts another embodiment of a platen assembly 360 which supports a web of polishing material 376 on which the polishing surface 130 is defined. The polishing material 376 is passed over a platen 362 between a supply roll 344 and take-up roll 346. The platen 362 includes an electrode 364 which is coupled to a power source 334 through a slip ring 332. A contact roller 366 is coupled to the power source 334 through the slip ring 332. The polishing material 376 includes a conductive layer 368 coupled to a dielectric subpad 370. The polishing surface 130 is defined on the conductive layer 368. A plurality of holes or apertures 372, one of which is shown in the embodiment of FIG. 3D, are provided such that an electrolyte disposed on the platen assembly 360 forms a conductive path between the conductive layer 368 and the electrode 364 when a bias is applied by the power source 334. One embodiment of a polishing material and platen assembly which may be adapted to benefit from the invention is described in U.S. patent application Ser. No. 11/695,484, filed Apr. 12, 2007, which is incorporated by reference in its entirety.

Returning to FIG. 1, the polishing surface 130 is configured, in one embodiment, to accommodate polishing of at least two substrates simultaneously thereon. In such an embodiment, the polishing station 124 includes two conditioning modules 132 and two polishing fluid delivery modules 134 which condition and provide polishing fluid to the region of the polishing surface 130 just prior to interfacing with a respective substrate 170. Additionally, each of the polishing fluid delivery modules 134 include an arm that is positioned to provide independently a predetermined distribution of polishing fluid on the polishing surface 130 so that a specific distribution of polishing fluid is respectively interfaced with each substrate during processing.

Figure 4:
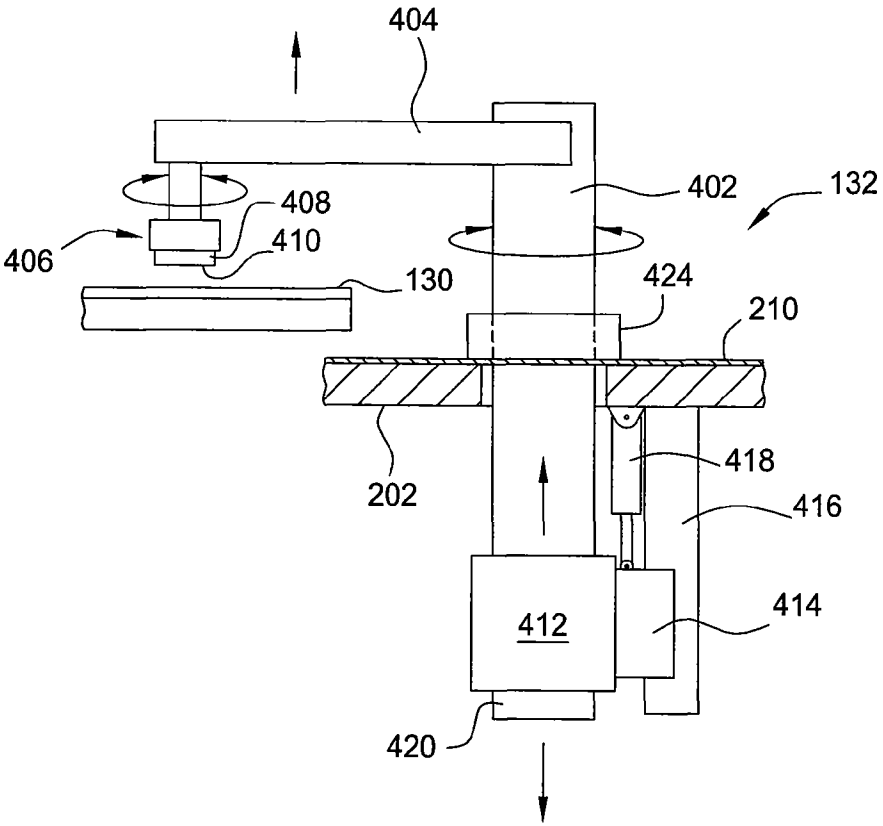
FIG. 4 depicts a side view of one embodiment of a conditioning module.

FIG. 4 depicts one embodiment of the conditioning module 132. The conditioning module 132 is coupled to the inner frame 202. The conditioning module 132 includes a tower 402 having an arm 404 extended cantilevered therefrom. The distal end of the arm 404 supports a conditioning head 406. A conditioning disk 408 is removably attached to the conditioning head 406. The rotational position, e.g., the sweep, of the conditioning head 406 is controlled by a motor or actuator 412 that is configured to rotate the arm 404 across the polishing surface 130 during conditioning, and to position the arm 404 clear of the polishing surface when desired. A second motor 420 is utilized to rotate the conditioning head 406 and/or disk 408 about an axis through the conditioning head 406 and/or disk 408. In one embodiment, the motor 420 is mounted below the basin 210 and is coupled to the conditioning head 406 by shafts and belts (not shown). One example of a conditioning module which may be adapted to benefit from the invention is described in U.S. patent application Ser. No. 11/209,167, filed Aug. 22, 2005, which is incorporated by reference in its entirety.

The elevation of the conditioning head 406 may be controlled by an actuator 418. In one embodiment, the actuator 418 is coupled to a guide 414. The guide 414 is coupled to the tower 402. The guide 414 may be positioned along a rail 416 which is coupled to the inner frame 202 so that the actuator 418 may control the elevation of the arm 404 and the conditioning head 406. A collar 424 is provided to prevent liquid from passing between the tower 402 and the basin 210. In one embodiment, the actuator 418 may be positioned in one of the heads 406 or arm 404 to control the elevation of the disk 408 relative to the polishing surface 130. In operation, the actuator 412 positions the conditioning head 406 over the polishing surface 130. The actuator 418 is actuated to bring a conditioning surface 410 of the disk 408 in contact with the polishing surface 130. The motor 420 imparts a rotational motion to the disk 408 about a central axis of the conditioning head 406. The disk 408 may be swept across the polishing surface 130 by the actuator 410 while conditioning. The elevation of the arm 404 above the polish fluid delivery module 134 permits a long arm 404, thereby allowing the head 406 to sweep the polishing surface 130 in a path more aligned with the pad radius, which promotes conditioning uniformity.

Figure 5:
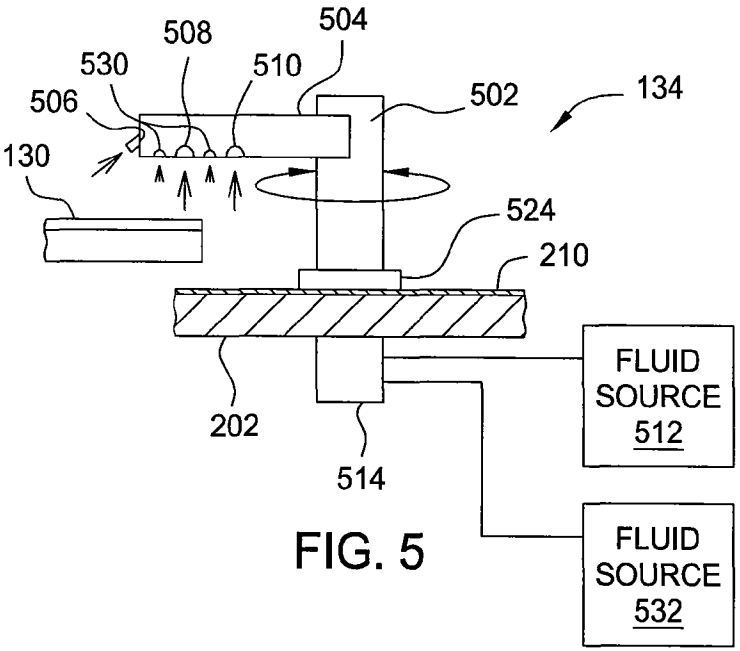
FIG. 5 depicts a side view of one embodiment of a polishing fluid delivery arm.

FIG. 5 depicts one embodiment of a polishing fluid delivery module 134. The polishing fluid delivery module 134 includes a tower 502 having an arm 504 extending cantilevered therefrom. The tower 502 is coupled to the inner frame 202 adjacent the polishing surface 130 and is short enough to remain clear of the arm 404 of the conditioning module 132. An actuator 514 is provided to control the rotational position of the arm 504 over the polishing surface 130 and may be actuated to swing the arm 504 completely clear of the polishing surface 130 when desired. The collar 524 is provided to prevent fluid from passing between the tower 502 and the basin 210.

A plurality of ports are provided on the arm 504 to provide polishing fluid from a fluid source 512 to the polishing surface 130. In the embodiment depicted in FIG. 5, three ports 506, 508, 510 are shown. It is contemplated that one or more ports may be utilized to provide polishing fluid to the polishing surface 130. It is also contemplated that each of the plurality of ports may be independently controlled to provide different amounts and/or compositions of polishing fluid to the polishing surface 130. Thus, between varying the angular orientation of the arm 504 and the amount and/or type of fluid provided through the ports 506, 508, 510, the distribution of polishing fluid on the polishing surface 130 may be controlled as desired. One embodiment of a fluid delivery module that may be adapted to benefit from the invention is described in U.S. patent application Ser. No. 11/298,643, filed Dec. 8, 2005, which is incorporated by reference in its entirety.

The polishing fluid source 512 may provide an electrolyte suitable for electrically assisted chemical mechanical polishing, slurry suitable for chemical mechanical polishing and/or other fluid suitable for processing the substrate 170 on the polishing surface 130. The polishing fluid source 512 may provide up to and exceeding 1000 ml/min of polishing fluid to the polishing surface 130. Since two polishing fluid delivery module 134 are utilized to deliver polishing fluid during the simultaneous polishing two substrates on a single polishing surface 130, some sharing of polishing fluid occurs relative each substrate so that an overall reduction in the amount of polishing fluid per substrate polished is realized over conventional systems.

Optionally, a plurality of nozzles 530 may be provided to direct a cleaning fluid onto the polishing surface 130 from a cleaning fluid source 532. In one embodiment, the cleaning fluid source 532 provides high pressure deionized water through the nozzles 530 to remove polishing by-products from the polishing surface 130.

Returning to FIG. 1, processed substrates are returned to the load cups 122 of the polishing module 106 for transfer by the wet robot 108 to the cleaner 104. The cleaner generally includes a shuttle 140 and one or more cleaning modules 144. The shuttle 140 includes a transfer mechanism 142 which facilitates hand-off of the processed substrates from the wet robot 108 to the one or more cleaning modules 144.

Figure 6A:
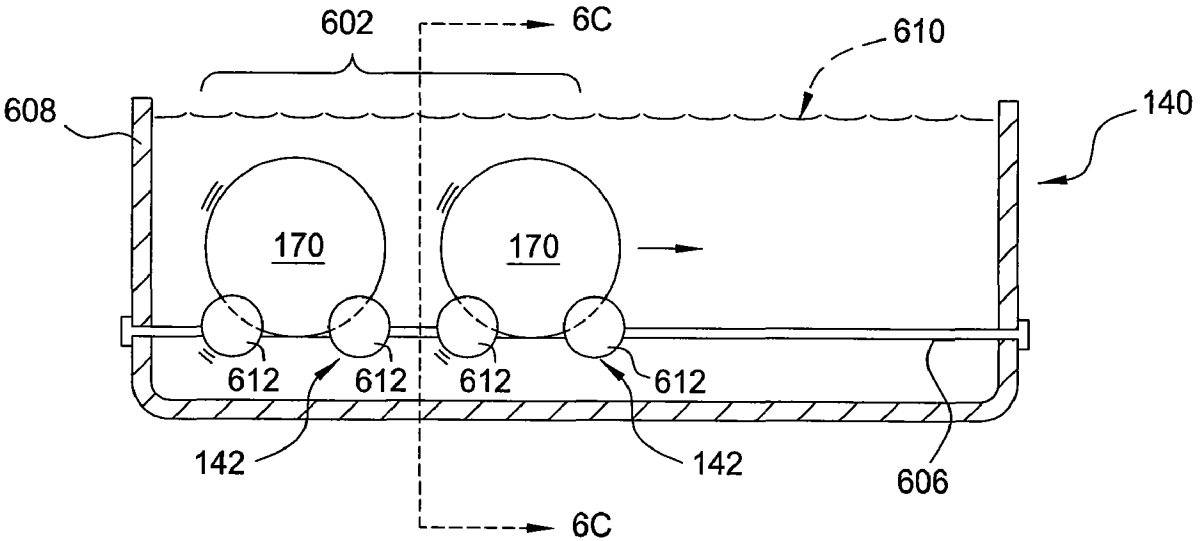
FIGS. 6A-B depict one embodiment of a shuttle illustrating motion of substrates disposed therein.
Figure 6B:
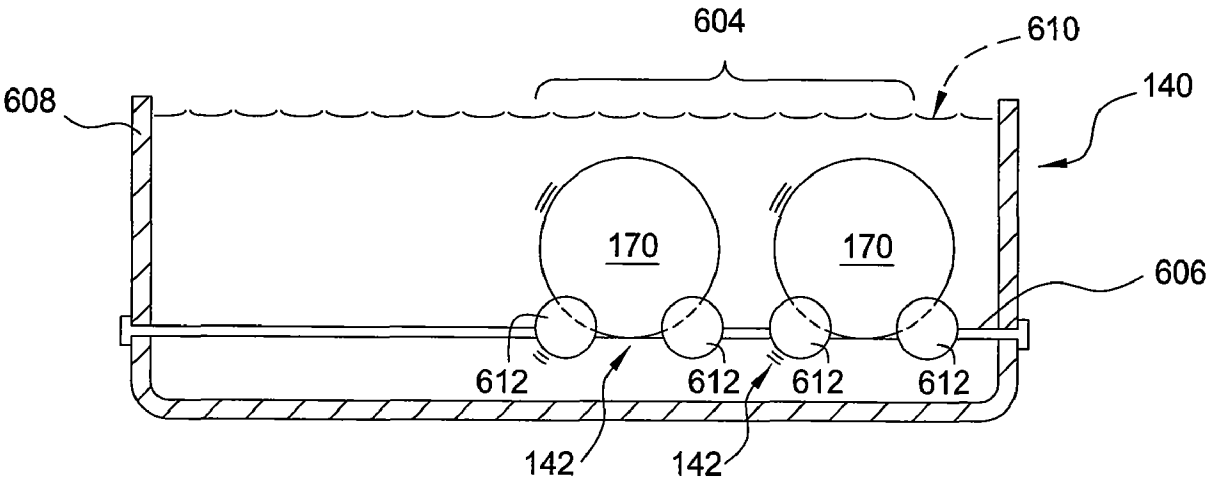
Figure 6C:
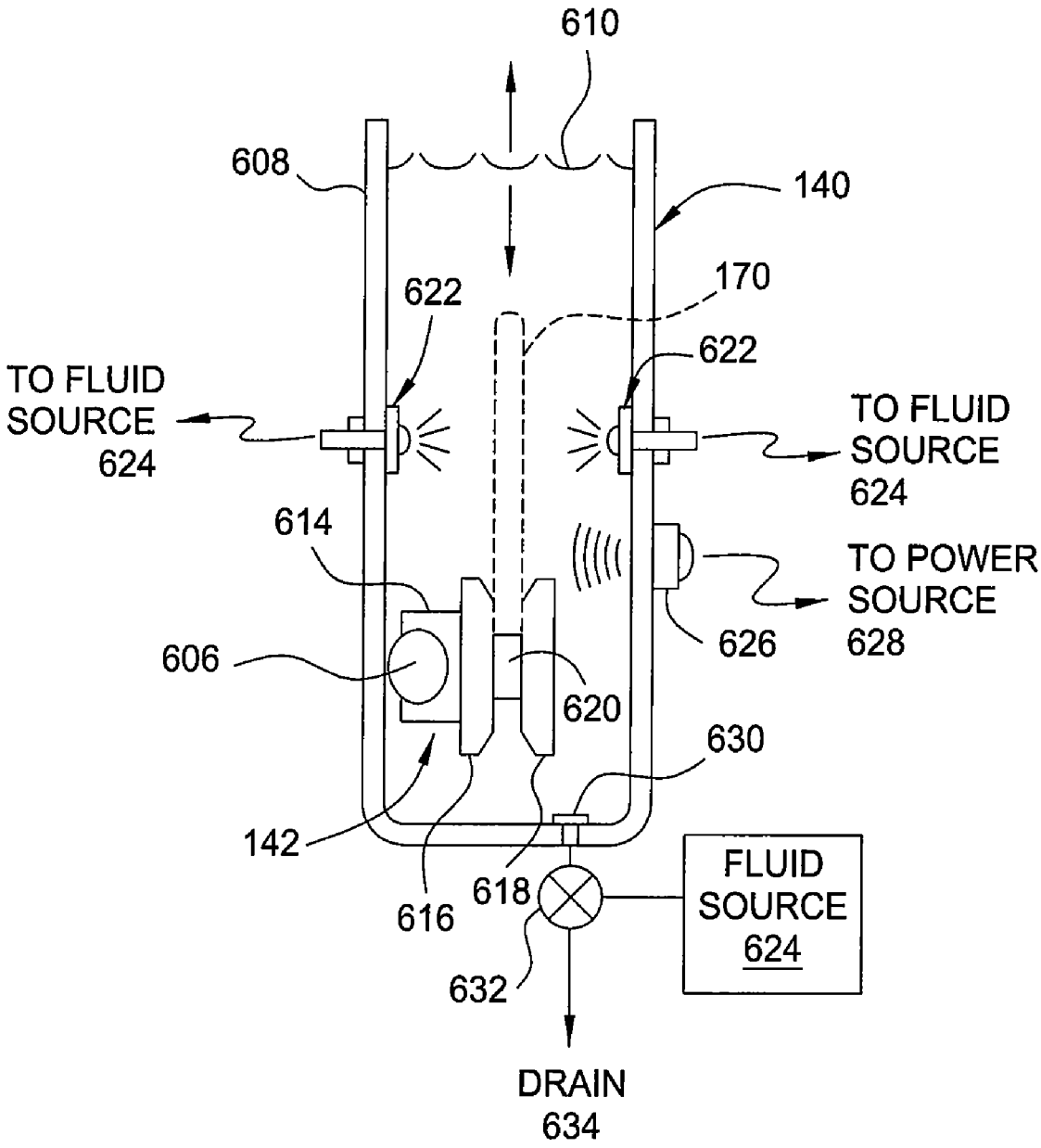
FIG. 6C is a sectional view of the shuttle of FIG. 6A taken along section line 6C-6C.

FIGS. 6A-C depict one embodiment of the shuttle 140. The transfer mechanism 142 of the shuttle 140 is utilized to move the polished substrates 170 returning from the polishing module 106 from a load position 602 proximate the wet robot 108 to a unload position 604 proximate the cleaner 104. In one embodiment, the transfer mechanism 142 is a rodless cylinder 606 which is mounted in a trough 608. A plurality of fixtures 612 are coupled to a guide 614. The guide 614 is controllably positioned along the rodless cylinder 606. The fixtures 612 are utilized to support the substrate 170 in a substantially vertical position while being moved between the load and unload positions 602, 604 as the guide 614 is advanced along the cylinder 606.

In one embodiment, two fixtures 612 are utilized to support a single substrate 170. In one embodiment, the fixture 612 includes two disks 616, 618 coupled by a cylinder 620. The cylinder 620 has a diameter much less than the diameters of the disks 616, 618, thereby creating a slot which receives the edge of the substrate 170. The pair of fixtures 612 supporting a single substrate may be coupled to a single guide 614. In another embodiment, two pairs of fixtures 612 supporting two substrates may be coupled to a single guide 614. It is contemplated that the substrate may be transferred within the shuttle 140 utilizing other suitable mechanisms.

In one embodiment, the trough 608 may be selectively filled with a fluid as shown by reference numeral 610. The fluid 610 may be a composition suitable for rinsing and/or loosening material from the substrate 170. In one embodiment, the fluid is deionized water. It is also contemplated that the fixtures 612 may be configured to cause the substrate 170 to rotate while being moved between the load and unload positions 602, 604, thereby enhancing the removal of polishing by-products from the surface of the substrate 170.

The level of the fluid within the trough 608 may be controlled by selectively opening and closing a selector valve 632 coupled to a port 630 formed in the bottom of the trough 608. The selector valve 632 may be set to allow fluid from a fluid source 624 to enter the volume defined in the trough 608, set in a position that seals the port 630 and/or set in a position that fluidly couples the port 630 to a drain 634 to facilitate removal of fluids from the trough 608.

In another embodiment, one or more fluid jets 622 may be provided to direct a stream of fluid against the surface of the substrate 170 while in the shuttle 140. In the embodiment depicted in FIG. 6C, two fluid jets 622 are provided on the side walls of the trough 608 to direct fluid against opposite sides of the substrate 170. The fluid may be provided through the jets 622 from the fluid source 624 or other fluid reservoir. It is also contemplated that air or other gas may be provided through the jets 622, either while the trough 608 is filled with a fluid or empty.

In another embodiment, one or more transducers 626 may be mounted to or deposed proximate the trough 608. The transducer 626 may be energized by a power source 628, thereby directing energy to the surface of the substrate 170 to enhance the removal of polishing by-products therefrom.

Returning to FIG. 1, the processed substrates are transferred from the shuttle 140 through of the one or more cleaning modules 144 by an overhead transfer mechanism (not shown in FIG. 1). In the embodiment depicted in FIG. 1, two cleaning modules 144 are shown in an aligned, parallel arrangement. Each of the cleaning modules 144 generally include one or more megasonic cleaners, one or more brush boxes, one or more spray jet boxes and one or more dryers. In the embodiment depicted in FIG. 1, each of the cleaning modules 144 includes a megasonic cleaner 146, two brush box modules 148, a spray jet module 150 and a dryer 152. Dried substrates leaving the dryer 152 are rotated to a horizontal orientation for retrieval by the dry robot 110 which returns the dried substrates 170 to an empty slot in one of the wafer storage cassettes 114. One embodiment of a cleaning module that may be adapted to benefit from the invention is a DESCIAE cleaner, available from Applied Materials, Inc., located in Santa Clara, Calif.

FIGS. 7A-D respectively are top, front, back and side views of one embodiment of an overhead transfer mechanism 700 of the cleaner 104 which may be utilized to advance the substrates 170 through the modules of the cleaner 104. In one embodiment, the overhead transfer mechanism 700 includes a pair of transfer devices 702. The transfer devices 702 are laterally staggered such that one of the transfer devices 702 has a range of motion sufficient to retrieve substrates 170 from the shuttle 140 and advance the retrieved substrate through at least the megasonic cleaner 146 and the two brush box modules 148. The other transfer device 702 has a range of motion sufficient to retrieve and advance substrates 170 from the brush box module 148 through the spray jet module 150 and the dryer 152. It is contemplated that transfer mechanisms having other configurations may be utilized.

In one embodiment, the transfer device 702 includes a guide 704 that may be selectively positioned along a main rail 706 by an actuator 708. In one embodiment, the actuator 708 is a lead screw driven by a stepper motor. It is contemplated that other types of actuators may be utilized to selectively position the guide 704 over portions of the cleaning module 144.

Figure 7A:
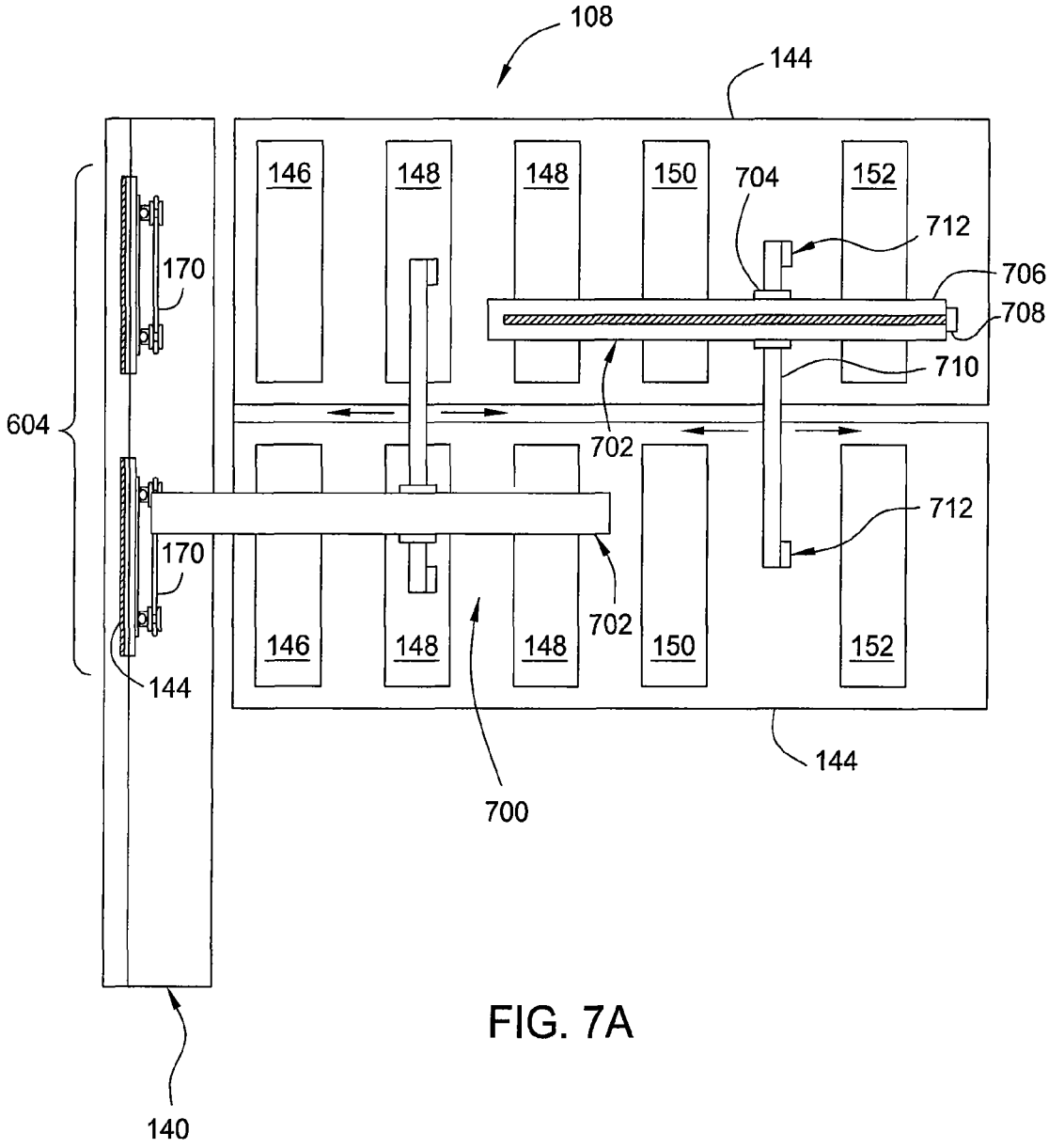
FIGS. 7A-D depict one embodiment of a cleaner having an overhead substrate transfer mechanism.
Figure 7C:
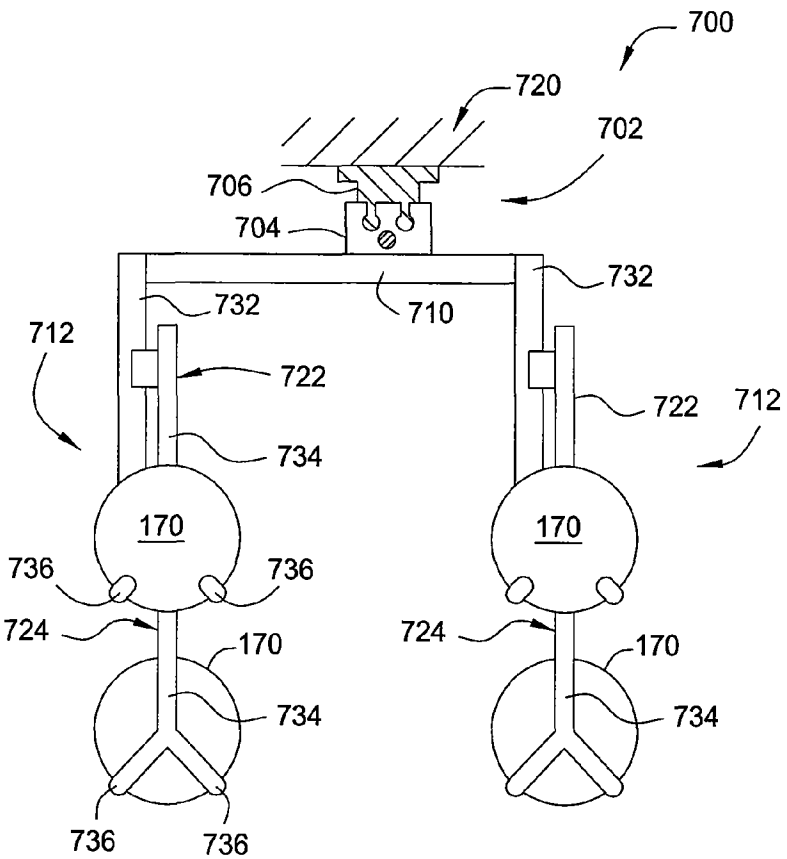
Figure 7B:
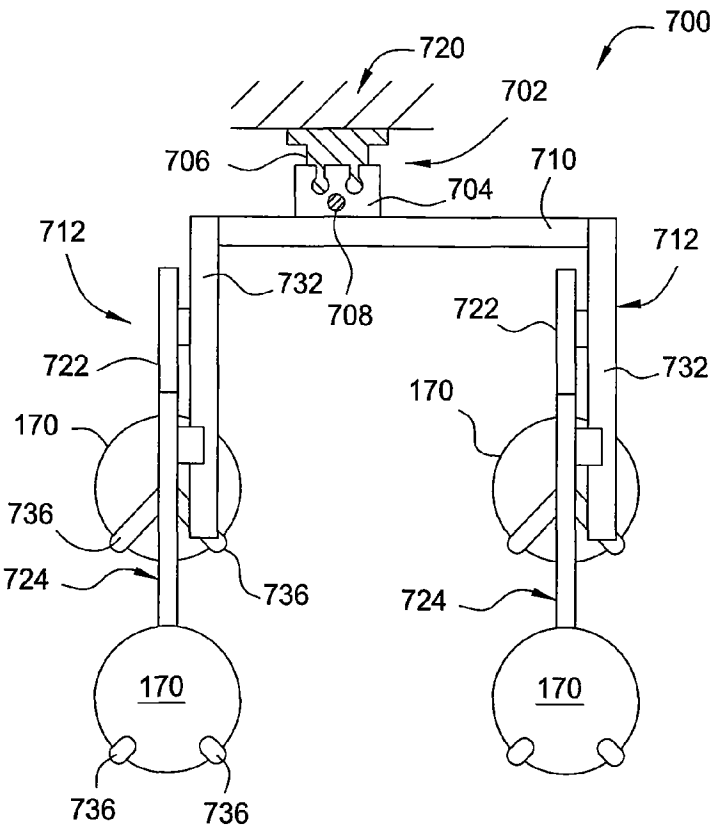
Figure 7D:
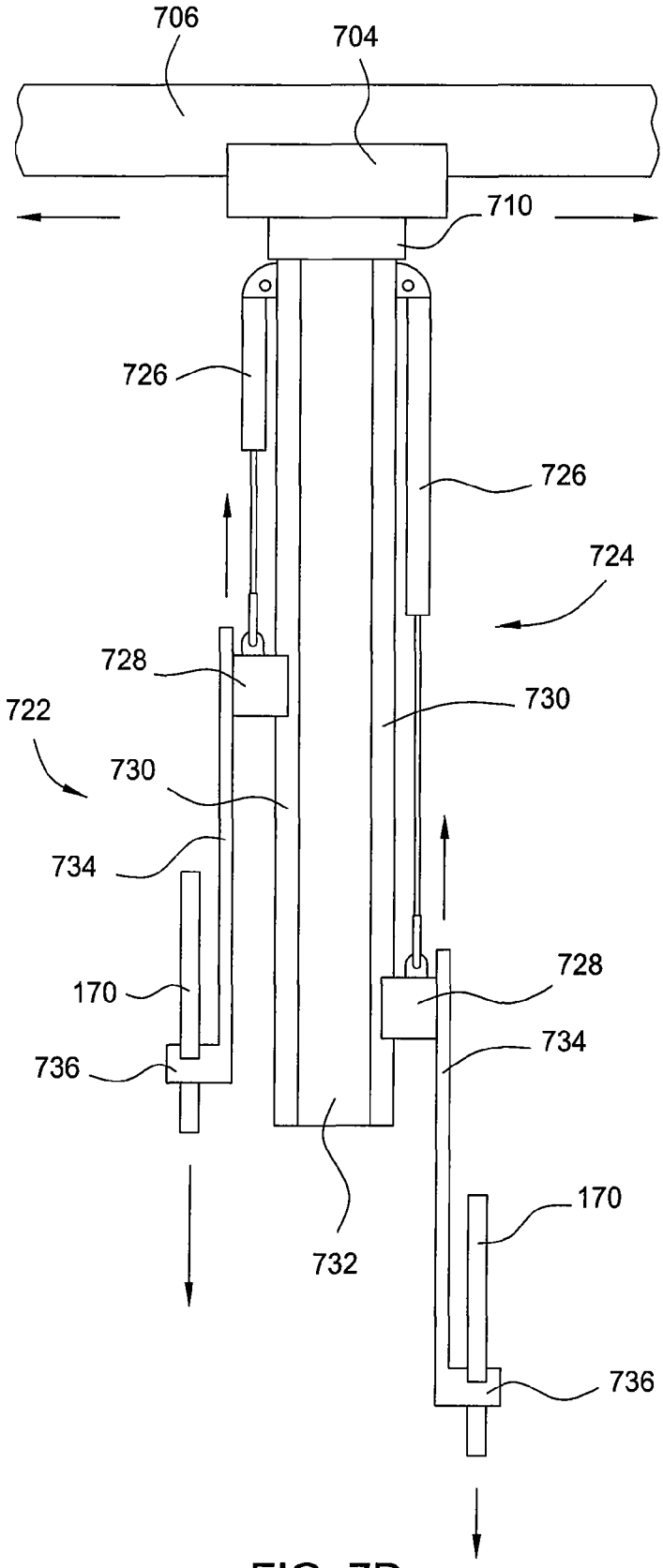

A cross member 710 is coupled to the guide 704. Two end effector assemblies 712 are coupled to opposite ends of the cross member 710. The cross member 710 is coupled to the guide 704 offset from its midpoint so that each end effector assembly 712 is centrally located above each of the cleaning modules 144, as illustrated in FIG. 7A. The rail 706 may be coupled to a support frame or structure 720 that suspends the transfer mechanism 700 above the cleaner 104.

Each end effector assembly 712 includes a first gripper assembly 722 and a second gripper assembly 724 coupled to a vertical support member 732. The vertical support member 732 is coupled to the cross member 710. Each gripper assembly 724, 722 includes a gripper 734 coupled to a rail 730 by a guide 728. The rails 730 are coupled to the vertical support member 732. An actuator 726 is provided to selectively position the guide 728 along the rail 730 so that the gripper 734 may be extended and retracted relative to the support member 732. The gripper 734 includes a plurality of fingers 736 which define a slot in which the substrate 170 may be secured. In operation, the first pair of the gripper assemblies is positioned to service a front end of each cleaning module while the second pair of the gripper assemblies is positioned to service a back end of each cleaning module. For example, the first gripper assembly 722 may be utilized to retrieve a brushed substrate from one of the modules, for example, the brush box module 148 of the cleaning module 144. Once the first gripper assembly 722 is retracted to position clear of the brush box module 148, the end effector assembly 712 is translated to position the second gripper assembly 724 over the now-empty brush box module 148. The second gripper assembly 724 is then extended to deposit another substrate 170 in the brush box module 148. The now-empty second gripper assembly 724 is then retracted clear of the brush box module 148 and the end effector assembly 712 is translated to the next module, such as the spray jet module 150. The empty second gripper assembly 724 is extended to retrieve a washed substrate from the spray jet module 150. The end effector assembly 712 is then translated to position the first gripper assembly 722 over the spray jet module 150, thereby allowing the brushed substrate retrieved from the brush box module 148 to be transferred to the now-empty spray jet module 150 by the first gripper assembly 722.

Thus, the sequence for loading the polishing module 106 with substrates to be polished has been described along with one mode of operation for passing substrates returning from the polishing module 106 through the cleaner 104 on route to the factory interface 102. As discussed above, the substrates entering the polishing module may be processed utilizing a number of sequences, some of which are illustrated below. It is contemplated that the polishing system 100 provides sufficient flexibility for other sequences to be utilized.

FIGS. 8A-13C depict various modes of operation of the polishing system 100 described above. The illustrative polishing sequences are not intended to be exhaustive of the possible polishing sequences which may be beneficially practiced in the polishing system 100, but merely illustrative of certain modes of operation.

Figure 8A:
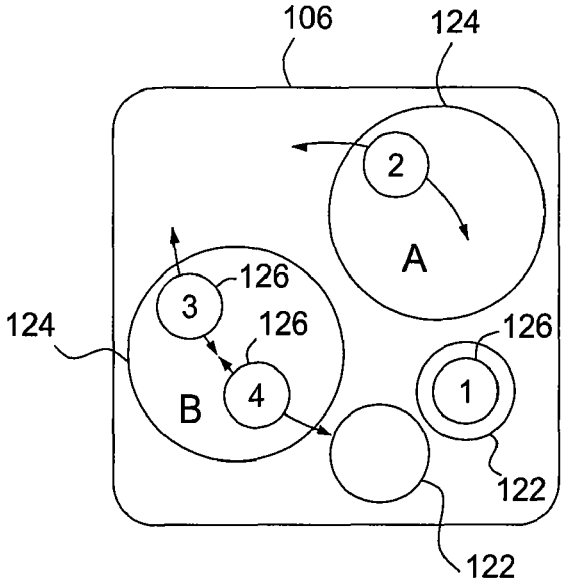
FIGS. 8A-13C depict various sequences for polishing a substrate that may be practiced in different embodiments of the polishing system.

FIGS. 8A-D illustrates one embodiment of a polishing sequence for serially polishing substrates on two polishing stations 124. The sequence is preformed on a polishing module 106 having two polishing stations 124, two load cups 122 and four polishing heads 126. The polishing heads 126 are supported on a carriage (not shown) in FIG. 8A which may be utilized to selectively position the polishing heads 126 respectively over the polishing stations 124 and load cups 122 as desired. As shown in FIG. 8A and other following figures, each of the polishing heads 126 are designated with the Arabic numerals 1, 2, 3 or 4 while the polishing stations 124 are designated A or B to illustrate the sequential movement of substrates retained in the polishing heads 126 through the polishing module 106 during operation. In the embodiment depicted in FIG. 8A, the polishing head 1 is shown engaged with one of the load cups 122 to receive a substrate to be polished. Polishing head 2 is positioned on polishing station A to polish a substrate 170 thereon. Polishing heads 3, 4 are shown positioned to engage substrates with the polishing station B located in the lower left corner of the polishing module 106.

While polishing, a polishing fluid is provided to the polishing surface 130 with the polishing head 126 and polishing surface 130 is rotated while in contact with the substrate that is rotated by the polishing head 126. The polishing head 126 may optionally be swept back and forth during processing. As indicated by the arrows, the sweep of the polishing heads 126 are only limited by the area of the polishing station 124, due in one embodiment by the continuous nature of the track upon which the carriage is adjustably positioned thereon.

Figure 8B:
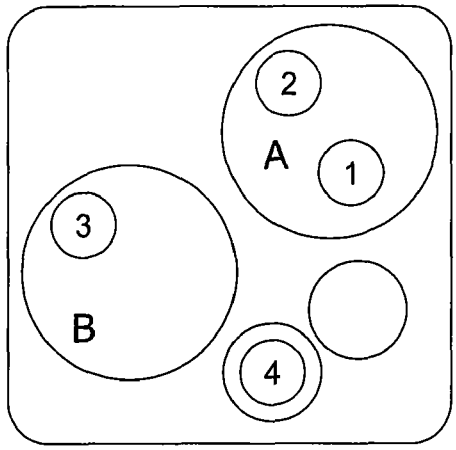
Figure 8C:
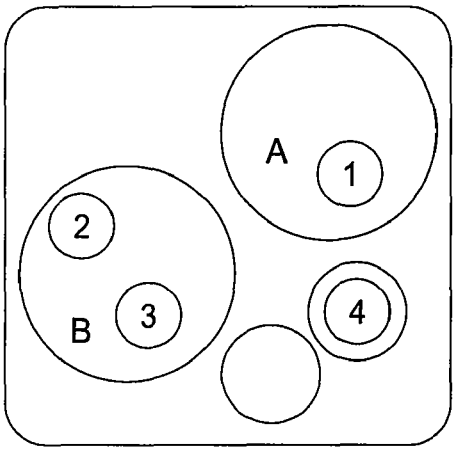
Figure 8D:
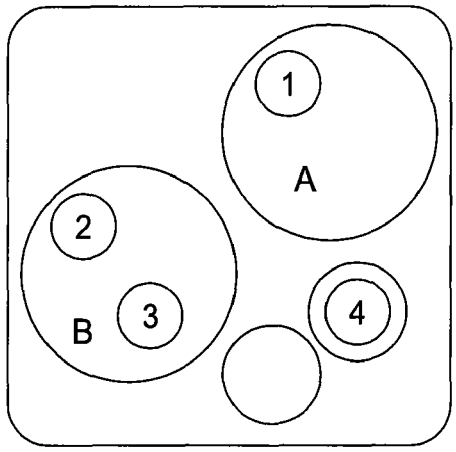

After a predetermined polishing period, the carriage having polishing head 1 secured thereto is actuated to position the polishing head 1 in the polishing station A. As shown in FIG. 8B, the movement of polishing head 1 is decoupled from the motion of polishing heads 2, 3, which remain in their respective positions engaged with the polishing stations A, B of the polishing module 106. Polishing head 4 moves from polishing station B to release a polished substrate 170 in the load cup 122.

During this time, the wet robot 108 transfers a substrate to be polished into the empty load cup 122 adjacent the load cup 122 containing the polished substrate. At FIG. 8C, polishing head 4, now empty, moves to the load cup 122 retaining the substrate to be polished so that the substrate may be loaded in the polishing head 4. Polishing head 3 moves to the opposite side of the polishing station B to make room for the polishing head 2 leaving polishing station A.

Polishing head 1 then moves to the opposite side of the polishing station B. At this point, the polishing head 4, now holding a substrate ready to be polished, is ready to move to polishing station A, similar to as shown in FIG. 8A.

FIGS. 8A-D depict one mode of operation wherein the substrates are processed in at least two polishing stations 124. An exemplary polishing process having such a sequence includes a process having a bulk removal of a conductive material, such as copper or tungsten, on a first polishing station followed by a residual removal of copper and/or a barrier layer on a second polishing station. Other two-step polishing processes may also be performed in this manner. In the configuration described above, a two-step copper polish (each step on a separate polishing station) may have a throughput of about 80 substrates per hour. For oxide removal processes, about 170 substrates per hour may be realized.

Figure 9A:
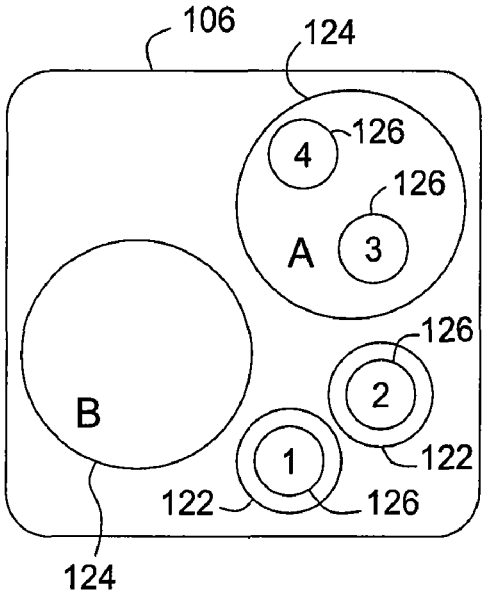
Figure 9B:
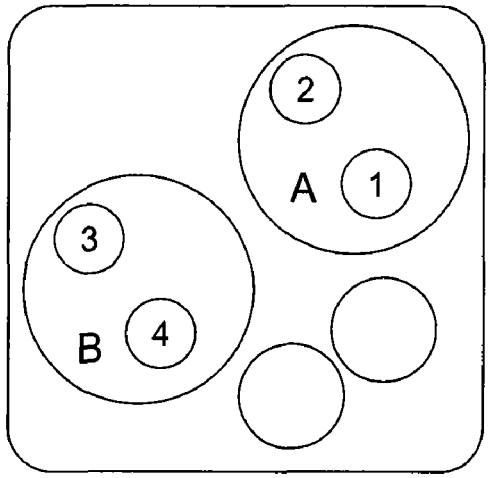
Figure 9C:
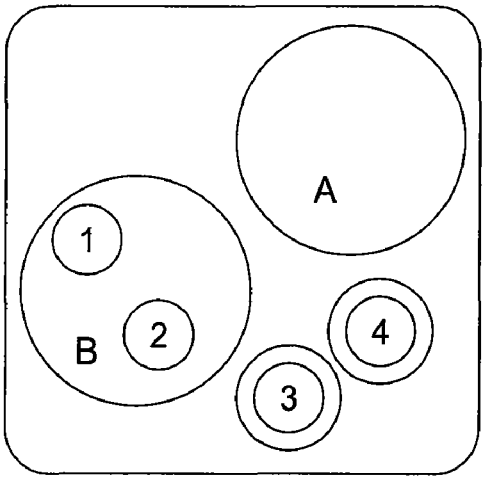
Figure 9D:
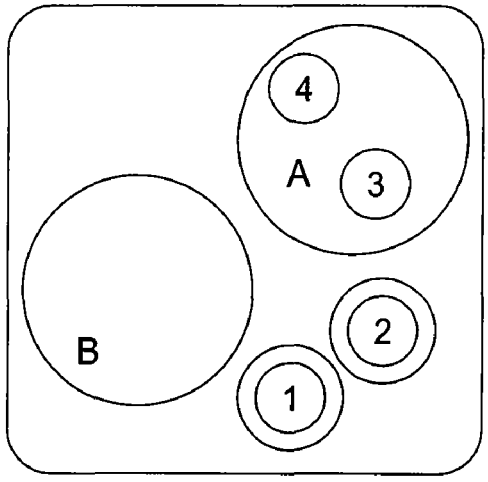

FIGS. 9A-D depict another embodiment of a polishing sequence which may be practiced on the polishing system 100. The polishing sequence depicted in FIGS. 9A-D are illustrative of a two-step polishing process wherein the substrates are polished in pairs, first on one polishing station followed by a polishing on a second polishing station. As shown in FIG. 9A, polishing heads 1 and 2 are interfaced with load cups 122 to retrieve substrates to be polished. The polishing heads 3 and 4 are positioned to process substrates in the polishing station A. Once the substrates to be polished are loaded into polishing heads 1, 2, the polishing heads 1, 2 are then rotated over polishing station B, as shown in FIG. 9B. When the substrates disposed in polishing heads 3, 4 have completed processing, polishing heads 3 and 4 are rotated to engage with the load cups 122 as shown in FIG. 9C. The polished substrates are transferred from the polishing heads 3, 4 to the load cups 122 where they are then retrieved by the wet robot 108 and moved to the cleaner 104. The wet robot 108 additionally transfers a new pair of substrates to be polished to the load cups 122, where they are then transferred to the polishing heads 3, 4. The polishing heads 3, 4 are then transferred to the empty polishing station A located in the upper right corner of the polishing module 106, thereby freeing the load cups 122 to engage with the polishing heads 1, 2 which are now ready to transfer polished substrates from the polishing module 106 and to receive a new pair of substrates to be polished, as shown in FIG. 9D.

FIGS. 10A-D depict another embodiment of a polishing sequence which may be practiced in the polishing module 106. The sequence depicted in FIGS. 10A-D illustrates a sequence in which substrates are polished in pairs on a single pad prior to removal from the polishing module.

Figure 10A:
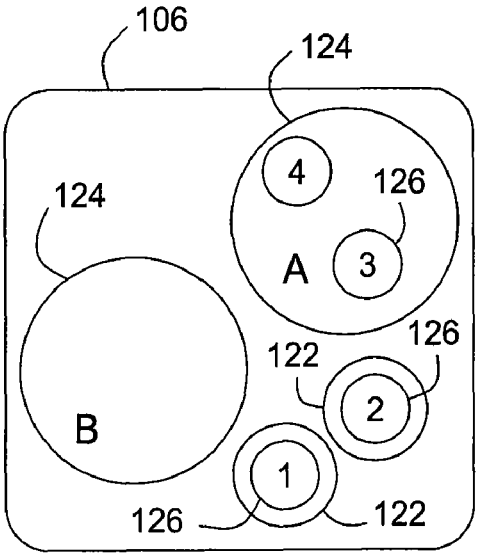
Figure 10B:
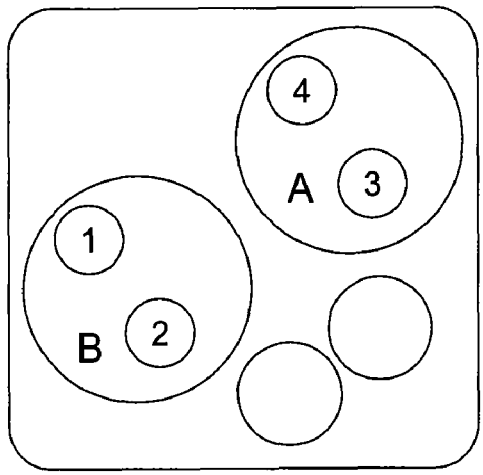
Figure 10C:
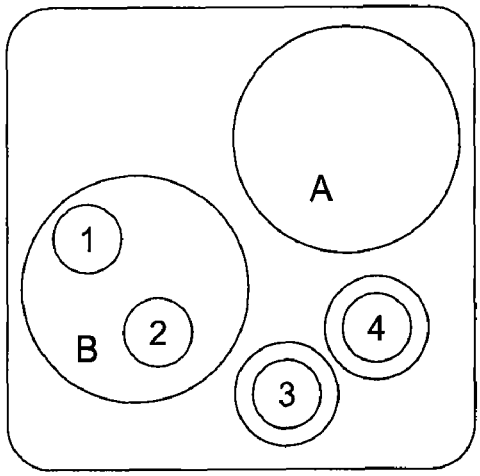
Figure 10D:
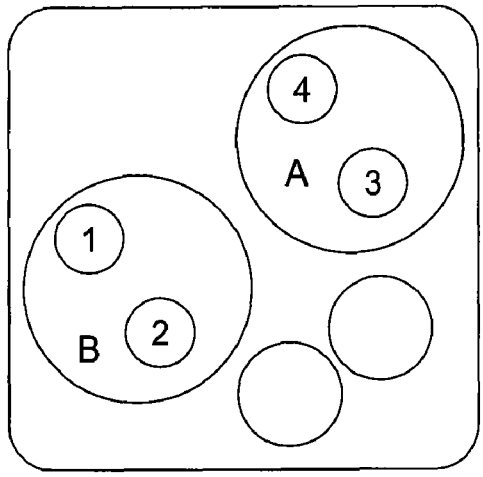

In the embodiment depicted in FIG. 10A, polishing heads 1, 2 are positioned over the load cups 122 to retrieve substrates 170 to be polished. Polishing heads 3, 4 are positioned over polishing station A. The polishing heads 1, 2 then transfer the substrates to the empty polishing station B. As shown in FIG. 10B, after the substrates retained in polishing heads 3, 4 have been polished, polishing heads 3, 4 are rotated to interface with the load cups 122 as shown in FIG. 10C. The polishing heads 3, 4 transfer the polished substrates to the load cups 122. The polished substrates are then removed from the load cups 172 by the wet robot 108. The wet robot 108 then loads a new pair of substrates to be polished into the load cups 122. The new pair of substrates is then transferred to the polishing heads 3, 4. The polishing heads 3, 4 then move the new substrates to be polished to the empty polishing station A, as shown in FIG. 10D, leaving the load cups 122 free to accept polished substrates from the polishing heads 1, 2 when processing is complete at polishing station B.

FIGS. 11A-H depict another embodiment of a polishing sequence which may be practiced in the polishing module 106. The sequence depicted in FIGS. 11A-H illustrates a sequence in which substrates are polished in pairs on two polishing surfaces 130 prior to removal from the polishing module 106. A second pair of load cups 122 is utilized in the corner of the polishing module 106 opposite the wet robot 108 as a buffer to enhance system throughput. The staging robot 136 (shown in FIG. 1) utilized to transfer substrates between load cups 122 is not shown in FIG. 11A-H for sake of clarity.

Figure 11A:
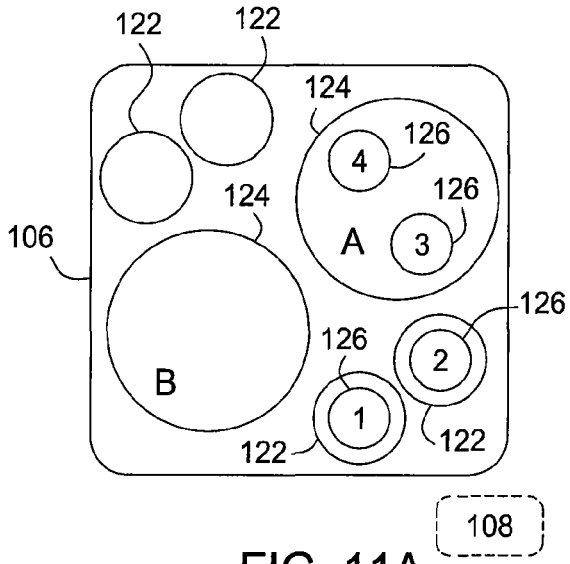
Figure 11B:
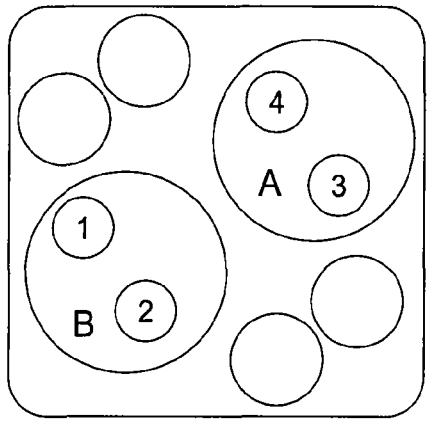
Figure 11C:
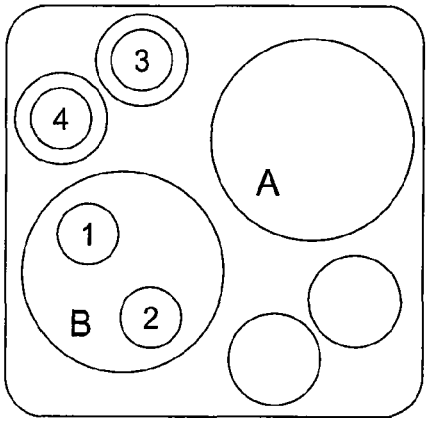

In the embodiment depicted in FIG. 11A, polishing heads 1, 2 are positioned over the load cups 122 to retrieve substrates 170 to be polished. Polishing heads 3, 4 are positioned over polishing station A. The polishing heads 1, 2 then transfer the substrates to the empty polishing station B, as shown in FIG. 11B. After the substrates retained in polishing heads 3, 4 have been polished, polishing heads 3, 4 are rotated to interface with the load cups 122 opposite the load cups 122 closest the wet robot 108, as shown in FIG. 11C, as the substrates retained in polishing heads 1, 2 continue to be polished on polishing station B.

Figure 11D:
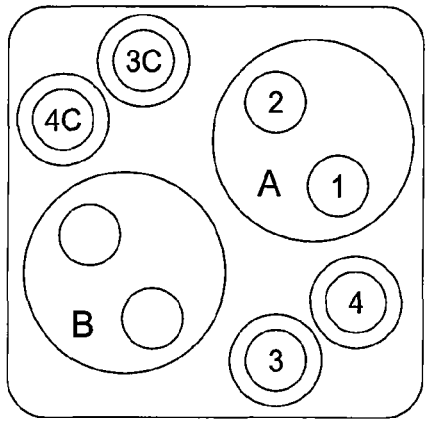
Figure 11E:
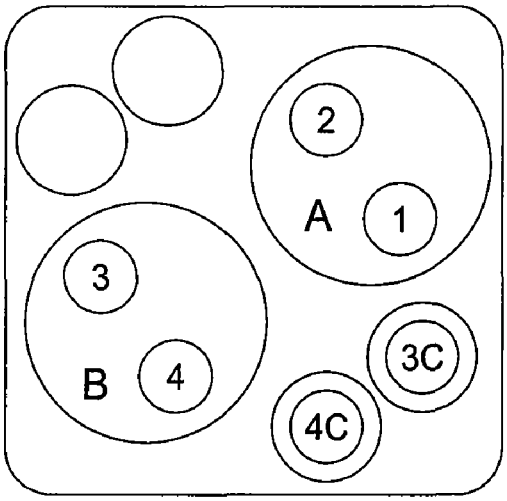
Figure 11F:
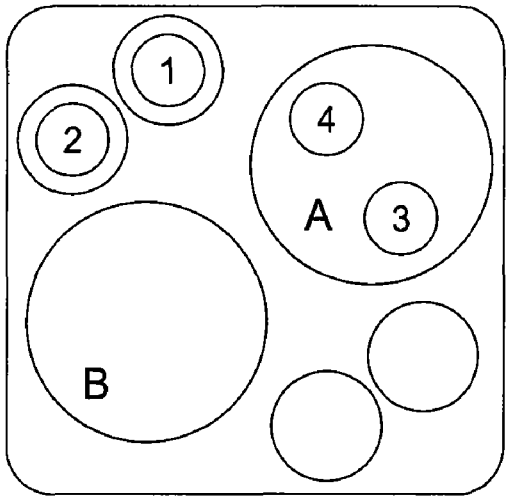

As illustrated in FIG. 11D, the polished substrates (designed by 3C, 4C) remain in the load cups 122 while the polishing heads 3, 4 rotate to the load cups 122 adjacent the wet robot 108 to retrieve a new pair of substrates 170 to be polished while the substrates retained in polishing heads 1, 2 are transferred to polishing station A. The polished substrates 3C, 4C are then transferred between load cups 122 by the staging robot 136, as shown in FIG. 11E. The polished substrates 3C, 4C are eventually removed from the polishing module 106 by the wet robot 108, as shown in FIG. 11F while the substrates retained in polishing heads 1, 2 are transferred to the load cups 172 from polishing station A after completing a two station polishing sequence.

Figure 11G:
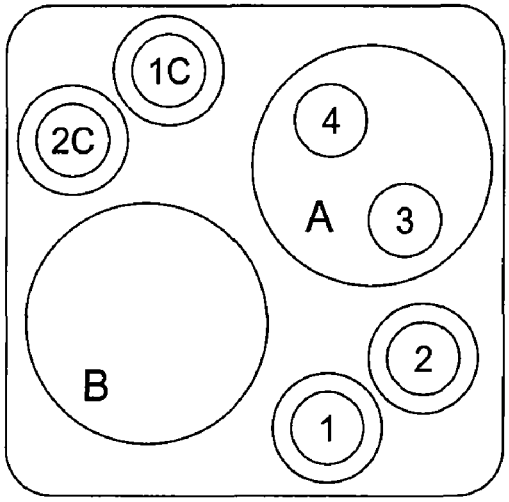
Figure 11H:
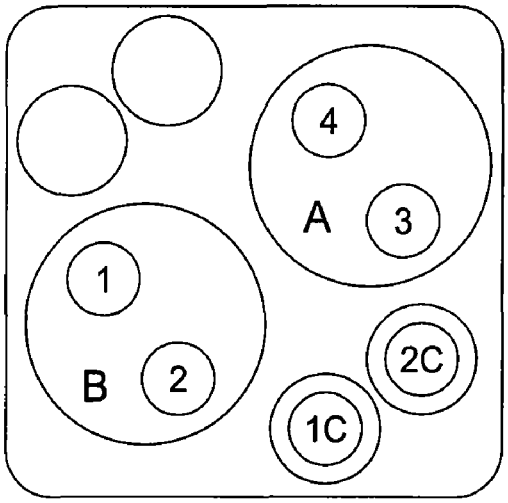

As shown in FIG. 11G, the polished substrates 1C, 2C are left in the load cups 122 while the polishing heads 1, 2 return to the load cups 122 closest the wet robot 108 to loads a new pair of substrates to be polished. The polishing heads 1, 2 transfer the new pair of substrates to be polished to the empty polishing station B, as shown in FIG. 11H, while the polished substrates 1C, 2C are transferred by the staging robot 136 to the load cups 172 closest the wet robot 108 where they are eventually removed from the polishing module 106 and transferred to the shuttle 140 of the cleaner 104 to the wet robot 108.

Figure 12A:
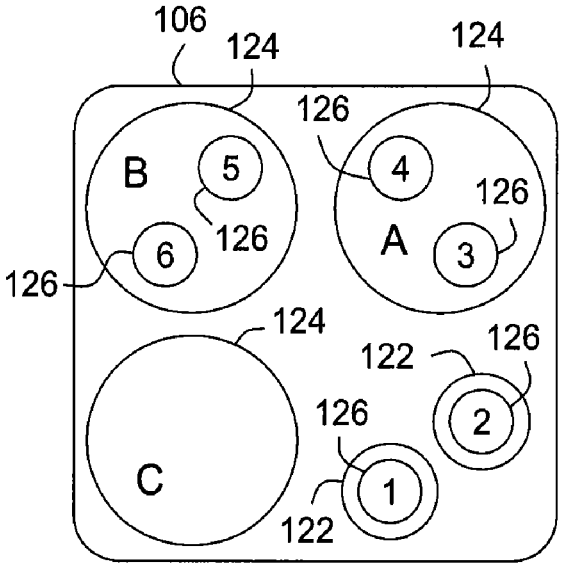
Figure 12B:
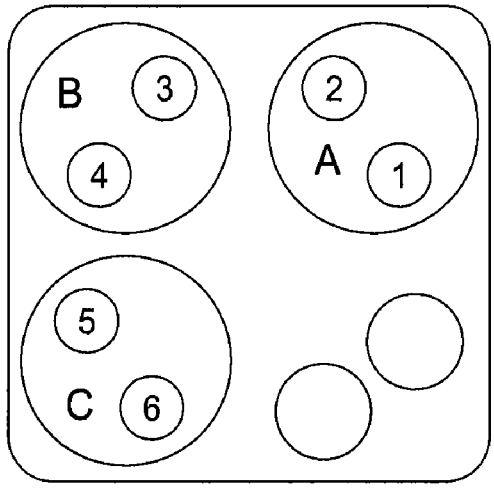
Figure 12C:
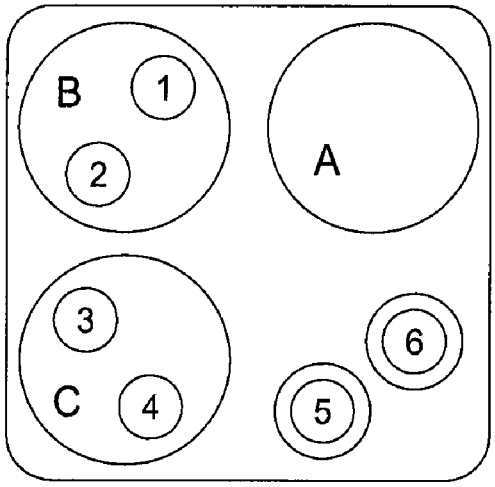

FIGS. 12A-C depict another embodiment of a polishing sequence which may be practiced in the polishing module 106. The sequence depicted in FIGS. 12A-C illustrates a sequence in which substrates are polished in pairs sequentially through at least three polishing stations 124 prior to removal from the polishing module.

In the embodiment depicted in FIG. 12A, polishing heads 1, 2 are positioned over the load cups 122 to retrieve substrates 170 to be polished. Polishing heads 3, 4 are positioned over polishing station A, while polishing heads 5, 6 are positioned over polishing station B. The polishing heads 5, 6 then transfer the substrates to the empty polishing station C, while the polishing heads 3, 4 advance to the now vacant polishing station B and the polishing heads 1, 2 advance to the now vacant polishing station A, as shown in FIG. 12B. The polishing heads 5, 6 then transfer the substrates to the load cups 122 from polishing station C, while the polishing heads 3, 4 advance to the now vacant polishing station C and the polishing heads 1, 2 advance to the now vacant polishing station B, as shown in FIG. 12C. After the polished substrates are exchanged for to be polished substrates at the load cups 122, the polishing heads 5, 6 then transfer the substrates to the polishing station A, repeating the sequence begun at FIG. 12 A.

Figure 13A:
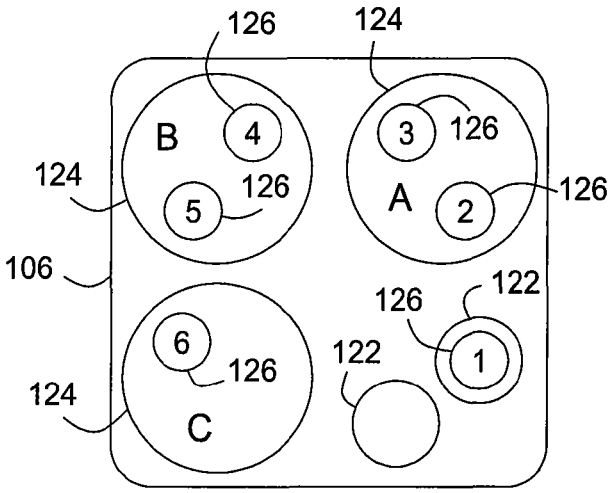
Figure 13B:
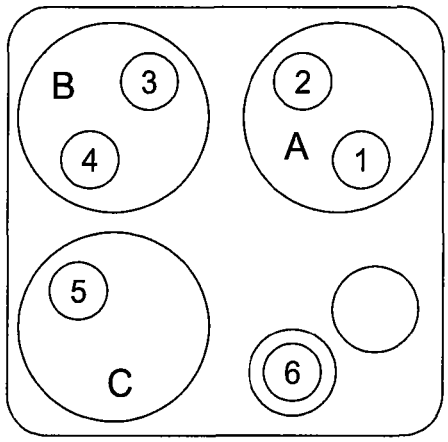
Figure 13C:
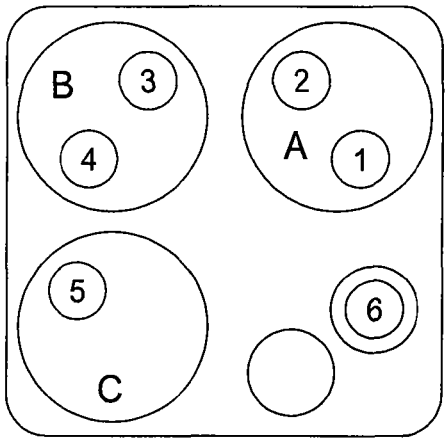

FIGS. 13A-C depict another embodiment of a polishing sequence which may be practiced in the polishing module 106. The sequence depicted in FIGS. 13A-C illustrates a sequence in which substrates are polished sequentially through at least three polishing stations 124 prior to removal from the polishing module.

In the embodiment depicted in FIG. 13A, polishing head 1 is positioned over one of the load cups 122 to retrieve substrates 170 to be polished. Polishing heads 2, 3 are positioned over polishing station A, while polishing heads 4, 5 are positioned over polishing station B and polishing head 6 is positioned over polishing station C, as shown in FIG. 13A. The polishing head 6 then transfers a polished substrate to the load cup 122 from the polishing station C, while the polishing head 5 advances to the now vacant polishing station C and the polishing heads 4, 3, 2, 1 advance to next counter clock-wise polishing station A, B, C, as shown in FIG. 13B. The polishing head 6 then receives a new substrate to be polished in one of the load cups 122, as shown in FIG. 13C.

While the foregoing is directed to embodiments of the present invention, other and further embodiments of the invention may be devised without departing from the basic scope thereof, and the scope thereof is determined by the claims that follow.

What is claimed is:

1. A polishing system comprising:

a polishing module;

a cleaner; and a robot having a range of motion sufficient to transfer substrates between the polishing module and cleaner, the polishing module comprising:

at least two polishing stations, wherein the at least two polishing stations each have a platen assembly configured to support a polishing pad;

at least one load cup; and at least four polishing heads, wherein each of the polishing heads is configured to move independently between each of the at least two polishing stations and the at least one load cup, and wherein the at least four polishing heads are coupled to an overhead circular track.

2. The polishing module of claim 1, wherein the cleaner comprises:

two cleaning modules, each cleaning module comprising a megasonic cleaning module, a brush box, a fluid jet module and a dryer.

3. The polishing module of claim 2, wherein the cleaner comprises:

a transfer mechanism having two pairs of gripper assemblies, wherein a first pair of the gripper assemblies is positioned to service a front end of each cleaning module and a second pair of the gripper assemblies is positioned to service a back end of each cleaning module.

4. The polishing module of claim 3 further comprising:

a shuttle configured to move substrate between the robot and the transfer mechanism.

5. The polishing module of claim 1, wherein each of said platen assemblies have a sufficient area to accommodate simultaneous interface with two polishing head during polishing.

6. The polishing module of claim 5, wherein the polish module comprises:

two conditioning modules and two polishing fluid delivery modules configured to interface with a polishing surface supported on the platen during polishing.

7. A polishing system comprising:

a polishing module comprising:

at least two polishing stations, wherein the at least two polishing stations each have a platen assembly configured to support a polishing pad;

at least two load cups;

a plurality of carriers coupled to an overhead circular track disposed over the at least two polishing stations, the carriers independently rotatable along the overhead track; and at least two polishing heads, each polishing head coupled to a respective one of the carriers, wherein the carriers are configured to independently position the polishing heads over each of the at least two polishing stations and the at least two load cups.

8. The polishing system of claim 7, further comprising:

a cleaner coupled to the polishing module, wherein the cleaner includes at least two cleaning modules, each cleaning module comprising a megasonic cleaning module, a brush box, a fluid get module and a dryer.

9. The polishing system of claim 8, further comprising:

a shuttle configured to move a substrate from the load cups to the cleaner.

10. The polishing system of claim 8, further comprising:

a robot configured to move a substrate between the polishing module and the cleaner.

11. The polishing system of claim 7, wherein each of said platen assemblies have a sufficient area to accommodate simultaneous interface with two polishing heads during polishing.

12. The polishing system of claim 7, further comprising:

an accessory device coupled to one of the carriers.

* * * * *

UNITED STATES PATENT AND TRADEMARK OFFICE

CERTIFICATE OF CORRECTION

PATENT NO. : 8,308,529 B2
APPLICATION NO. : 12/427411
DATED : November 13, 2012
INVENTOR(S) : D'Ambra et al.

It is certified that error appears in the above-identified patent and that said Letters Patent is hereby corrected as shown below:

In the Detailed Description:

Column 10, Line 27, please delete "DESCIAE" and insert -- DESCIA® -- therefor.

Signed and Sealed this
Second Day of April, 2013

Teresa Stanek Rea
*Acting Director of the United States Patent and Trademark Office*